United States Patent [19]

Stamou

[11] 3,939,956

[45] Feb. 24, 1976

[54] HOLDER FOR TYPEWRITER PAPER

[76] Inventor: Sam Stamou, 178 Prescott Ave., Toronto, Ontario, Canada, M6N 3H1

[22] Filed: July 24, 1974

[21] Appl. No.: 491,365

[52] U.S. Cl. ..... 197/133 R; 197/133 F; 197/180

[51] Int. Cl.[2] ..... B41J 15/04; B41J 29/06

[58] Field of Search..... 197/133, 130, 127 R, 180

[56] References Cited

UNITED STATES PATENTS

| | | | |
|---|---|---|---|
| 1,939,202 | 12/1933 | Caton | 197/133 R |
| 2,077,428 | 4/1937 | Mabon | 197/133 F |
| 2,104,484 | 1/1938 | Janney | 197/133 F |
| 2,534,391 | 12/1950 | Von Duyke | 197/133 F |
| 2,587,827 | 3/1952 | Fleischmann | 197/133 F |

*Primary Examiner*—Anton O. Oechsle

[57] ABSTRACT

A holder is provided for paper for typewriters which employ rolls of paper or consecutively joined sheets of computer paper in various sizes. The holder comprises a base upon which the typewriter may sit, upright side portions which are capable of supporting a roll of paper, and sliding shelves between the upright side portions. When consecutively joined sheets of computer paper are to be used in the typewriter, a stack is placed on the upper shelf and the used paper is fed back onto a lower shelf that has been partially pulled out.

6 Claims, 4 Drawing Figures

FIG. 2

HOLDER FOR TYPEWRITER PAPER

BACKGROUND OF THE INVENTION 1. Field of the Invention

This invention relates to a holder for paper for use with typewriters that employ rolls of paper or joined, perforated, rectangular sheets of paper of various sizes such as those used in computer terminals, the perforations being along join lines between the consecutive sheets of rectangular computer paper.

2. Description of the Prior Art

When rolls of paper are used in typewriters at present, a simple bracket with grooves for holding the roll is sometimes used. The bracket is placed on a desk behind the typewriter and the used paper is allowed to accumulate on the floor near the desk.

When consecutively joined, rectangular sheets of computer paper are to be used in the typewriter, the bracket with the roll must be removed and the pile of new paper placed on the desk behind the typewriter. Again, the used paper is allowed to fall to the floor near the desk.

SUMMARY OF THE INVENTION

A holder is provided for paper for typewriters which employ rolls of paper or joined, perforated sheets of computer paper in various sizes. The holder comprises a base upon which the typewriter may sit, upright side portions which are capable of supporting a roll of paper, and sliding shelves between the upright side portions. When consecutively joined rectangular sheets of computer paper are to be used in the typewriter, a stack of the paper is placed on the upper shelf and the used paper is fed back onto a lower shelf that has been partially pulled out.

BRIEF DESCRIPTION OF THE DRAWINGS

A preferred embodiment of this invention is illustrated in the drawings as follows.

DESCRIPTION OF THE PREFERRED EMBODIMENT

Figure 1:
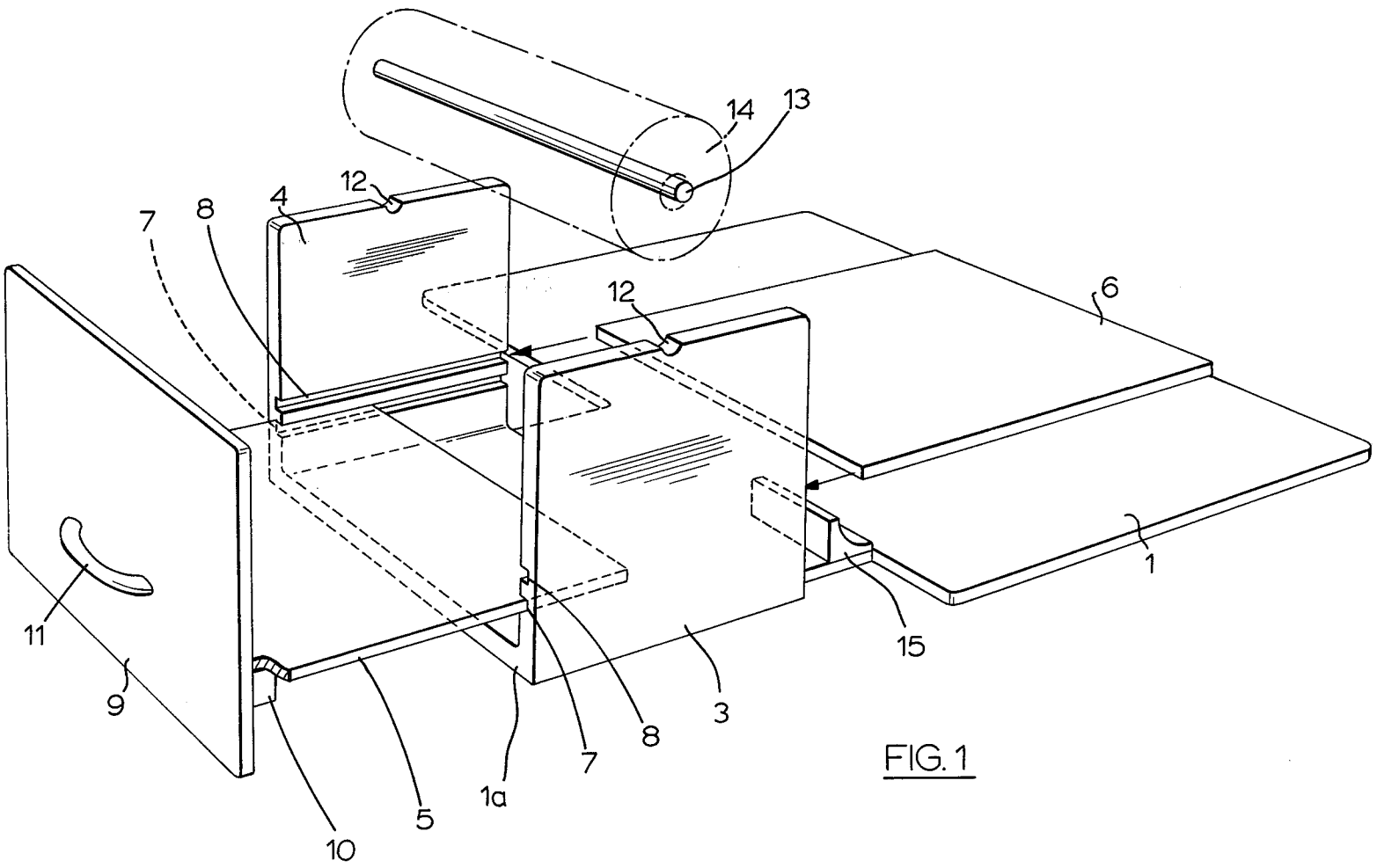
FIG. 1 is an exploded perspective view of the paper holder.
Figure 2:
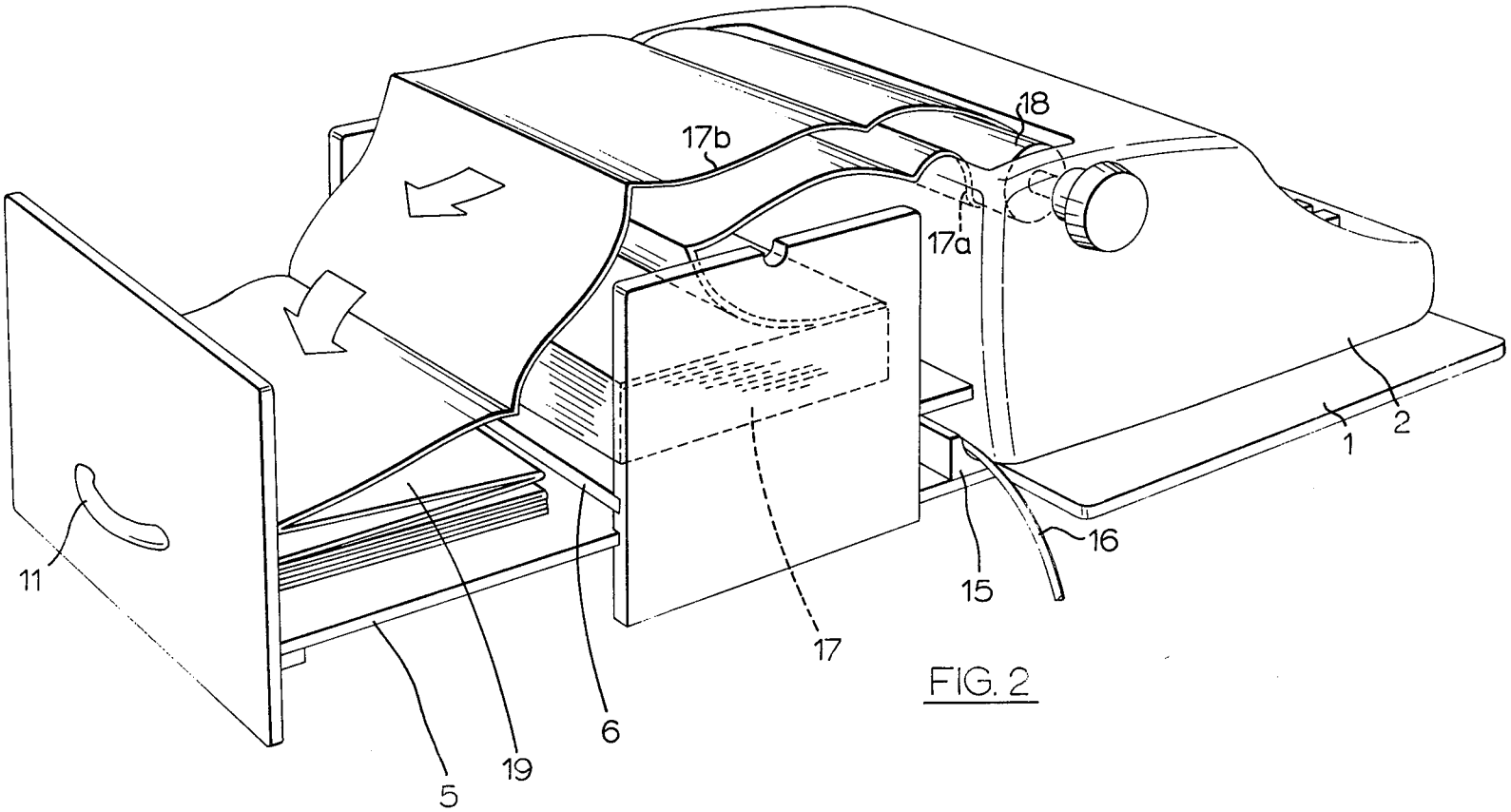
FIG. 2 is a perspective view of the paper holder in use with consecutively joined sheets of rectangular computer paper.

The holder illustrated in FIG. 1 comprises a frame 1 upon which sits a typewriter 2 as shown in FIG. 2. The frame 1 has a rearward extension 1a, and upright side portions 3, 4 are fixed to this extension. Shelves 5, 6 are slidable in grooves 7, 8 in the upright side portions 3, 4. Attached to shelf 5 is drawer face 9 which is secured to shelf 5 and is braced by support bar 10. A handle 11 is attached to drawer face 9 for ease of pulling out shelf 5. The upright side portions 3, 4 have grooves 12 in their top edges into which will fit the rod 13 of a roll of paper 14. Cradle 15 is attached to frame 1 to support the electrical cables 16 (FIG. 2) running from the typewriter to a power supply and computer terminal.

FIG. 2 shows the holder in use with consecutively joined sheets of rectangular computer paper. Typewriter 2 is placed on frame 1 as shown. The electrical cable 16 is positioned in cradle 15 so that it will hang free of the paper holder. A stack of new paper 17 is placed on upper shelf 6. The paper is threaded at 17*a* around typewriter roller 18, then back over the stack, at 17*b*, and down into a pile 19 on lower shelf 5 which has been pulled out by handle 11 to a distance slightly greater than the length of a sheet of the computer paper. The weight of the typewriter on the base prevents the unit from toppling rearwardly under the weight of the paper if the extension 1 *a* extends rearwardly from the top of a desk.

Figure 3:
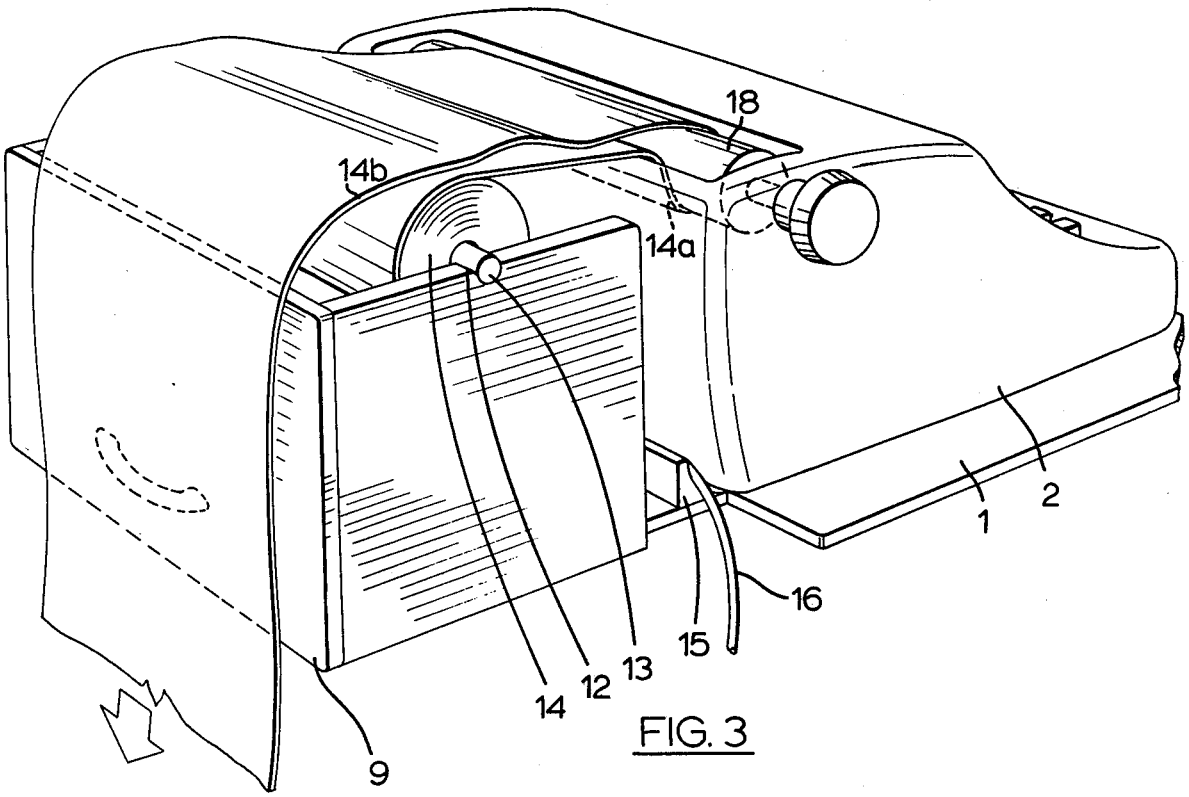
FIG. 3 is a perspective view of the paper holder in use with a roll of paper.

FIG. 3 shows the same holder in use with a roll of paper. The rod 13 of the roll of paper 14 rests in the grooves 12 of the upright side portions 3, 4 so that the roll can rotate freely. The paper is threaded at 14*a* around typewriter roller 18, passes up over the roll of paper at 14*b* and then down onto the floor or other convenient receptacle. Neither shelf 5 nor shelf 6 is needed here and drawer face 9 is kept closed against the upright portions 3, 4, to be out of the way. Alternatively, lower shelf 5 may be pulled out to receive the paper. Again, the electrical cable 16 rests in cradle 15.

Figure 4:
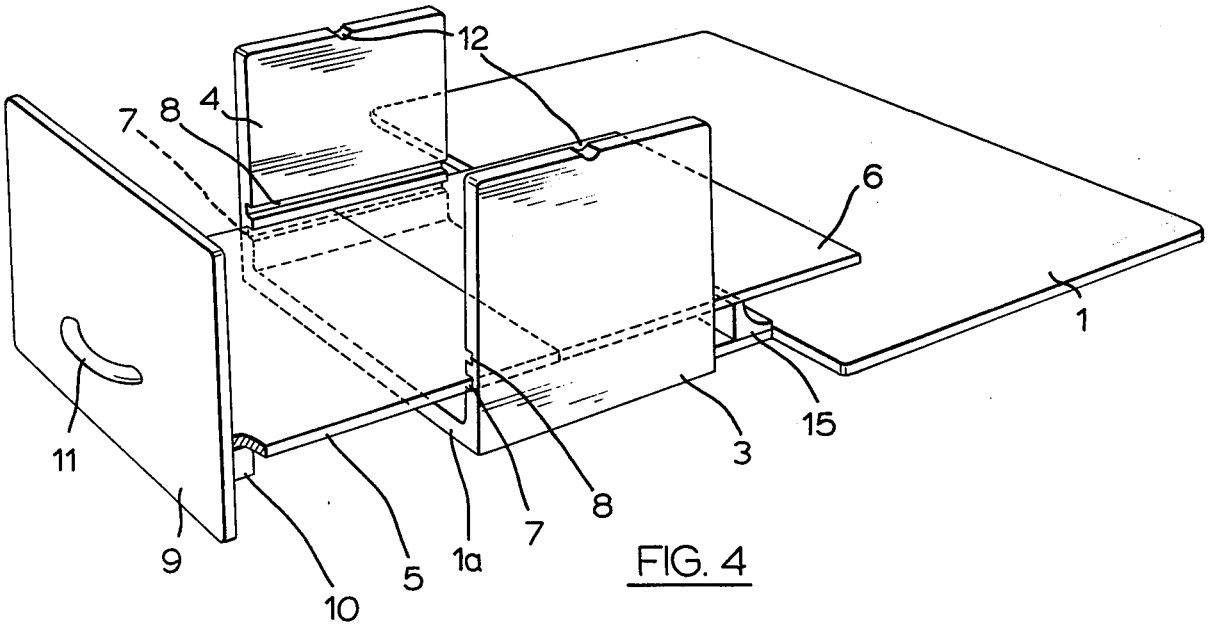
FIG. 4 is a perspective view of the paper holder in use with large sheets of rectangular computer paper.

If computer paper with sheets much longer than the length of one shelf is to be used, the two-shelf configuration shown in FIG. 2 cannot be used. In this case, shown in FIG. 4, to accommodate the longer paper in the holder, upper shelf 6 is withdrawn from its grooves 8, lower shelf 5 is partially pulled out and upper shelf 6 is placed in grooves 7 behind and thus on the same level as lower shelf 5. The combination of the two shelves in the same grooves will accommodate the longer sheets of paper.

The embodiments of the invention in which an exclusive property or privilege is claimed are defined as follows:

1. A holder for typewriter paper comprising a frame having upright and side portions and open front and rear ends, said upright side portions having means for supporting a roll of paper, an upper and a lower shelf between the upright side portions, and means supporting said upper and lower shelves for frontward and rearward sliding, the upper shelf being capable of supporting a stack of consecutively joined sheets of rectangular paper to be fed to a typewriter and the lower shelf being movable from under the upper shelf to a position where it can receive said paper after typing , and one of said shelves being withdrawable from between said uprights and insertable rearwardly behind the other of said shelves on said supporting means when said other shelf is partially withdrawn forwardly, to provide a paper support of increased area.

2. A holder as claimed in claim 1 wherein the means for holding a roll of paper comprise arcuate grooves in the top of the upright side portions.

3. A holder as claimed in claim 1 wherein said supporting means comprise upper and lower grooves in the upright side portions in which the shelves are slidable, the upper shelf being removable from the upper grooves and insertable into the lower grooves when the lower shelf has been partially pulled out.

4. A holder as claimed in claim 1 wherein the frame includes a cradle for guiding electric cables from the typewriter to the side of the base.

5. A holder as claimed in claim 1 wherein the frame has a base portion extending rearwardly beyond the upright side portions on which can be placed a typewriter to counter-balance the weight of paper supported on said holder.

6. A holder as claimed in claim 1 wherein said side portions comprise side walls, and said lower shelf carries a front drawer face member for closing the open front end of said holder when said lower shelf is inserted between the side walls.

* * * * *

UNITED STATES PATENT OFFICE
CERTIFICATE OF CORRECTION

Patent No. 3,939,956 Dated February 24, 1976

Inventor(s) Sam Stamou

It is certified that error appears in the above-identified patent and that said Letters Patent are hereby corrected as shown below:

On the cover sheet the illustrative figure should appear as shown below.

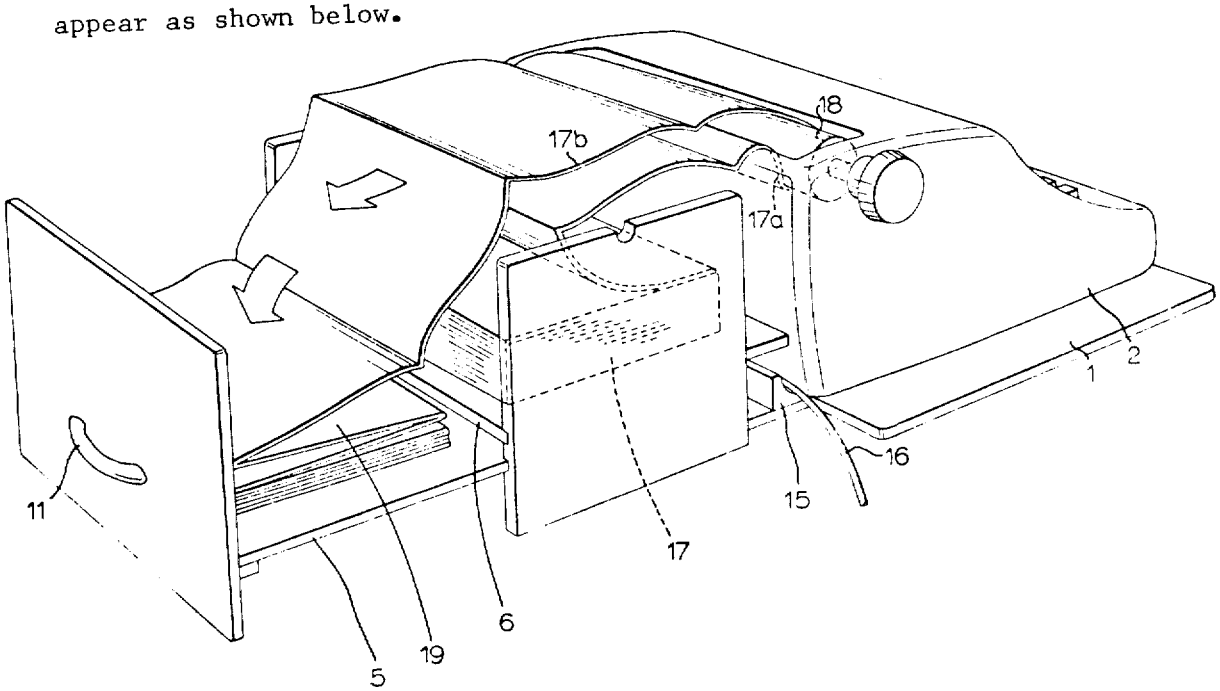

Signed and Sealed this eleventh Day of May 1976

[SEAL]

Attest:

RUTH C. MASON
Attesting Officer

C. MARSHALL DANN
Commissioner of Patents and Trademarks